US009738087B2

(12) United States Patent
Kato et al.

(10) Patent No.: US 9,738,087 B2
(45) Date of Patent: Aug. 22, 2017

(54) INKJET PRINTING APPARATUS AND CONTROL METHOD WITH COORDINATED FILLING OPERATIONS

(71) Applicant: CANON KABUSHIKI KAISHA, Tokyo (JP)

(72) Inventors: Masataka Kato, Yokohama (JP); Kazuo Suzuki, Yokohama (JP); Masaya Uetsuki, Yokohama (JP); Toshimitsu Danzuka, Tokyo (JP); Tsuyoshi Ibe, Yokohama (JP); Shin Genta, Yokohama (JP); Tomoki Yamamuro, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/158,298

(22) Filed: May 18, 2016

(65) Prior Publication Data

US 2016/0347078 A1 Dec. 1, 2016

(30) Foreign Application Priority Data

May 25, 2015 (JP) ..... 2015-105844

(51) Int. Cl.
*B41J 2/195* (2006.01)
*B41J 2/175* (2006.01)
*B41J 2/165* (2006.01)

(52) U.S. Cl.
CPC ..... *B41J 2/17566* (2013.01); *B41J 2/16505* (2013.01); *B41J 2/175* (2013.01)

(58) Field of Classification Search
CPC .... B41J 2/17566; B41J 2/17596; B41J 2/195; B41J 2/1752; B41J 29/393
See application file for complete search history.

(56) References Cited

U.S. PATENT DOCUMENTS

| | | | | |
|---|---|---|---|---|
| 5,509,140 | A | 4/1996 | Koitabashi et al. | 347/86 |
| 5,670,997 | A | 9/1997 | Sugimoto et al. | 347/30 |
| 5,671,000 | A | 9/1997 | Hirabayashi et al. | 347/86 |

(Continued)

FOREIGN PATENT DOCUMENTS

| | | | |
|---|---|---|---|
| EP | 2862719 | 4/2015 | B41J 2/165 |
| JP | 2014-079973 | 5/2014 | |

OTHER PUBLICATIONS

Extended European Search Report dated Oct. 24, 2016, in counterpart European Patent Application No. 16000984.1.

*Primary Examiner* — Juanita D Jackson
(74) *Attorney, Agent, or Firm* — Fitzpatrick, Cella, Harper & Scinto

(57) ABSTRACT

An inkjet printing apparatus includes a printhead, a subtank for storing ink to be supplied to the printhead, a maintank for storing ink to be supplied to the subtank, a valve that can be switched between an open state in which the printhead communicates with the subtank and a closed state in which the printhead does not communicate with the subtank, a cap for covering an discharging port surface of the printhead, a pump for generating a negative pressure in an inside of the cap with the cap covering the discharging port surface, and an internal pressure changing member for changing an internal pressure of the subtank to perform a subtank filling operation in which ink is supplied from maintank to the subtank.

10 Claims, 13 Drawing Sheets

(56) References Cited

U.S. PATENT DOCUMENTS

| | | | | |
|---|---|---|---|---|
| 5,742,311 | A | 4/1998 | Koitabashi et al. | 347/86 |
| 6,012,808 | A | 1/2000 | Koitabashi et al. | 347/86 |
| 6,062,671 | A | 5/2000 | Kanda et al. | 347/30 |
| 6,095,642 | A | 8/2000 | Koitabashi et al. | 347/86 |
| 6,145,978 | A | 11/2000 | Kato et al. | 347/101 |
| 6,168,268 | B1 | 1/2001 | Sugiyama | 347/89 |
| 6,231,167 | B1 | 5/2001 | Tsuboi et al. | 347/65 |
| 6,231,172 | B1 | 5/2001 | Koitabashi et al. | 347/86 |
| 6,299,298 | B1 | 10/2001 | Koitabashi et al. | 347/86 |
| 6,332,675 | B1 | 12/2001 | Koitabashi et al. | 347/86 |
| 6,390,578 | B1 | 5/2002 | Koitabashi et al. | 347/7 |
| 6,394,590 | B1 | 5/2002 | Koitabashi et al. | 347/86 |
| 6,447,084 | B1 | 9/2002 | Uetsuki et al. | 347/7 |
| 6,474,797 | B2 | 11/2002 | Kurata et al. | 347/85 |
| 6,540,321 | B1 | 4/2003 | Hirano et al. | 347/22 |
| 6,629,758 | B2 | 10/2003 | Okamoto et al. | 347/85 |
| 6,637,872 | B2 | 10/2003 | Ara et al. | 347/85 |
| 6,755,500 | B2 | 6/2004 | Hirano et al. | 347/22 |
| 6,824,258 | B2 | 11/2004 | Yamamoto et al. | 347/86 |
| 6,929,341 | B2 | 8/2005 | Mizoguchi et al. | 347/7 |
| 7,033,006 | B2 | 4/2006 | Ebisawa et al. | 347/85 |
| 8,789,918 | B2 | 7/2014 | Danzuka | 347/33 |
| 2002/0024543 | A1* | 2/2002 | Kimura | B41J 2/17509 347/7 |
| 2008/0158312 | A1 | 7/2008 | Kaga | 347/85 |
| 2009/0027435 | A1* | 1/2009 | Katada | B41J 2/17556 347/14 |
| 2009/0141075 | A1 | 6/2009 | Umeda | 347/30 |
| 2010/0103208 | A1 | 4/2010 | Asami et al. | 347/7 |

* cited by examiner

INKJET PRINTING APPARATUS AND CONTROL METHOD WITH COORDINATED FILLING OPERATIONS

BACKGROUND OF THE INVENTION

Field of the Invention

The present invention relates to an inkjet printing apparatus in which ink is supplied from an ink tank to an inkjet printhead and a control method thereof.

Description of the Related Art

An inkjet printing apparatus having a system in which ink is supplied from a maintank to a printhead through a subtank has been known. Japanese Patent Laid-Open No. 2014-79973 discloses a system in which a variable-volume member is provided in a flow path that makes a subtank and a printhead communicated with each other. In this system, the volume of the member is changed to supply ink from the maintank to the subtank, thereby filling the subtank with ink. Specifically, the volume of the member is contracted to move ink in the member to the subtank and to move air in the subtank to the maintank. Then, the volume of the member is expanded to move ink in the subtank to the member and to move ink in the maintank to the subtank.

In the system disclosed in Japanese Patent Laid-Open No. 2014-79973, an operation which fills the subtank with ink is performed, with ink stored in the member. Therefore, for example, in an initial state in which ink is stored only in the maintank, after ink is supplied to the member or the like, the subtank is filled with ink. As a result, it takes a relatively long time to complete the filling of the subtank with ink.

SUMMARY OF THE INVENTION

An object of the present invention is to provide an inkjet printing apparatus and a control method which can reduce the time until filling with ink is completed, as compared to a system according to the related art.

In a first aspect of the present invention, there is provided an inkjet printing apparatus comprising: a printhead having an discharging port surface on which an discharging port for discharging ink is formed; a subtank for storing ink to be supplied to the printhead; a maintank for storing ink to be supplied to the subtank; a valve that can be switched between an open state in which the printhead communicates with the subtank and a closed state in which the printhead does not communicate with the subtank; a cap for covering the discharging port surface; a pump for generating a negative pressure in an inside of the cap with the cap covering the discharging port surface; and an internal pressure changing member for changing an internal pressure of the subtank to perform a subtank filling operation in which ink is supplied from maintank to the subtank.

In a second aspect of the present invention, there is provided a control method of an inkjet printing apparatus including a printhead having an discharging port surface on which an discharging port for discharging ink is formed, a subtank for storing ink to be supplied to the printhead, a maintank for storing ink to be supplied to the subtank, and a cap for covering the discharging port surface, the control method comprising: a first step of generating a negative pressure in an inside of the cap with the cap covering the discharging port surface when the printhead does not communicate with the subtank; a second step of changing an internal pressure of the subtank after the first step to supply ink from maintank to the subtank; and a third step of causing the printhead and the subtank to communicate with each other after the second step to supply ink from the maintank to the printhead through the subtank.

According to the above-described structure, the inkjet printing apparatus includes the internal pressure change member that can change the internal pressure of the subtank. Therefore, the internal pressure of the subtank can be changed to supply ink in the maintank to the subtank. As a result, it is possible to reduce the time until filling with ink is completed.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the drawings.

First Embodiment

Figure 1:
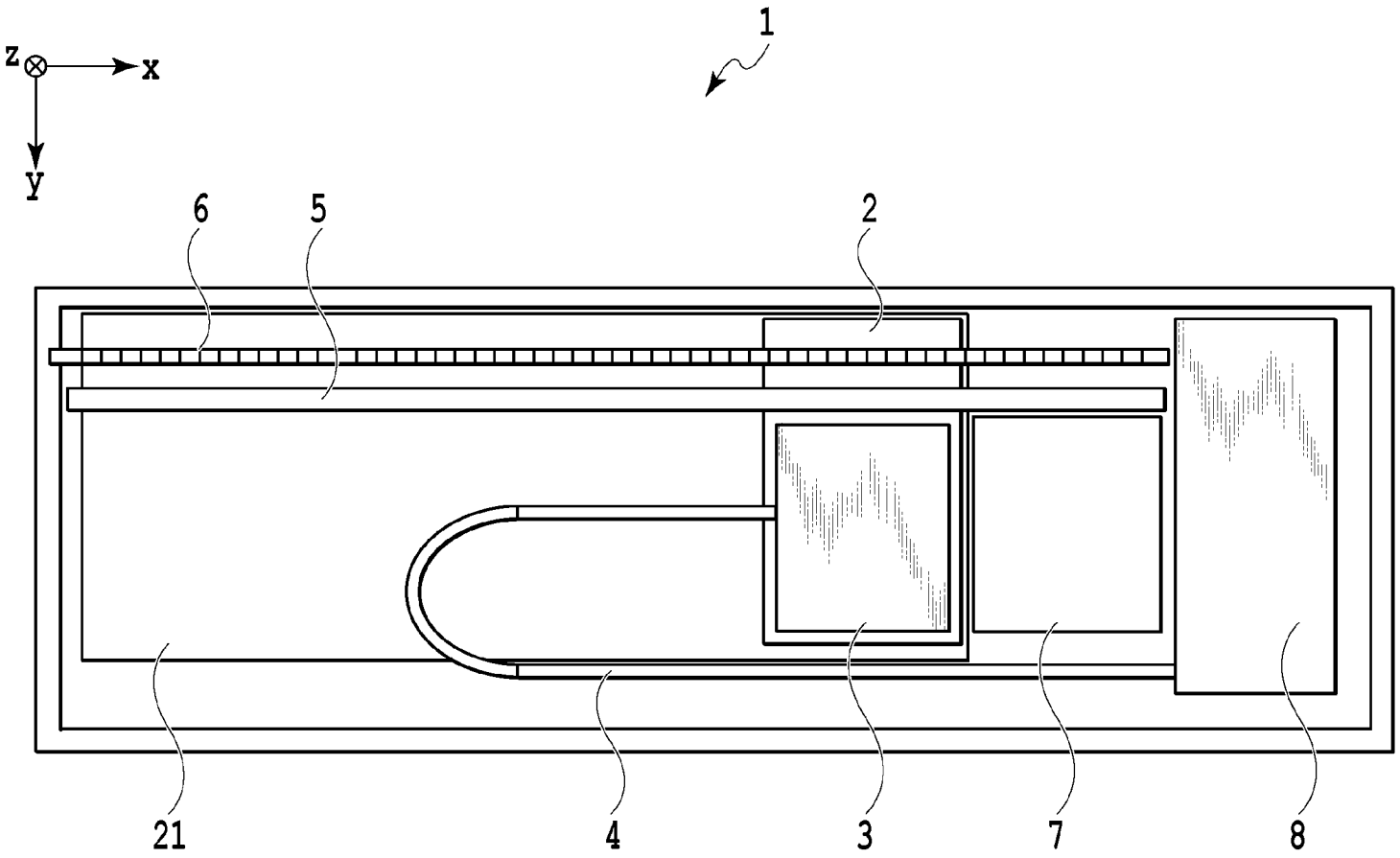
FIG. 1 is a diagram schematically illustrating the structure of a printing apparatus.

FIG. 1 is a diagram schematically illustrating the structure of an inkjet printing apparatus (hereinafter, referred to as a "printing apparatus") 1. The printing apparatus 1 is a serial printing apparatus which can perform printing on a relatively large printing medium such as A1 paper or A0 paper. As illustrated in FIG. 1, the printing apparatus 1 includes a carriage 2, a printhead 3, a supply tube 4, a guide shaft 5, an endless belt 6, a recovery processing unit 7, and an ink supply unit 8. The carriage 2 is supported by the guide shaft 5 so as to be movable along the guide shaft 5 that extends in an x direction in FIG. 1 and is fixed to the endless belt 6 that is moved in a direction substantially parallel to the direction in which the guide shaft 5 extends. The endless belt 6 is reciprocated by the driving force of a carriage motor (CR motor) to reciprocate the carriage 2 in the x direction.

The printhead 3 is detachably mounted on the carriage 2. Ink is stored in the ink supply unit 8. The ink supply unit 8 supplies ink to the printhead 3. Discharging ports (not illustrated) from which ink can be ejected are provided in a surface (discharging port surface) of the printhead 3 which faces a printing medium 21.

The printhead 3 and the ink supply unit 8 are connected to each other by the supply tube 4 and ink in the ink supply unit 8 is supplied to the printhead 3 through the supply tube 4. The supply tube 4 is made of a flexible material. The supply tube 4 has a section which is moved following the movement of the carriage 2 and is configured such that it can supply ink to the printhead 3 even when the carriage 2 is moved. As illustrated in FIG. 1, the supply tube 4 is provided so as to have a section that is substantially parallel to the moving direction of the carriage 2. The arrangement of the supply tube 4 is not limited to that illustrated in FIG. 1.

The recovery processing unit 7 performs, for example, a recovery processing operation for recovering an ejection performance of the printhead 3. The printing medium 21 is conveyed in a y direction in FIG. 1 by a conveying mechanism (not illustrated).

Figure 2:
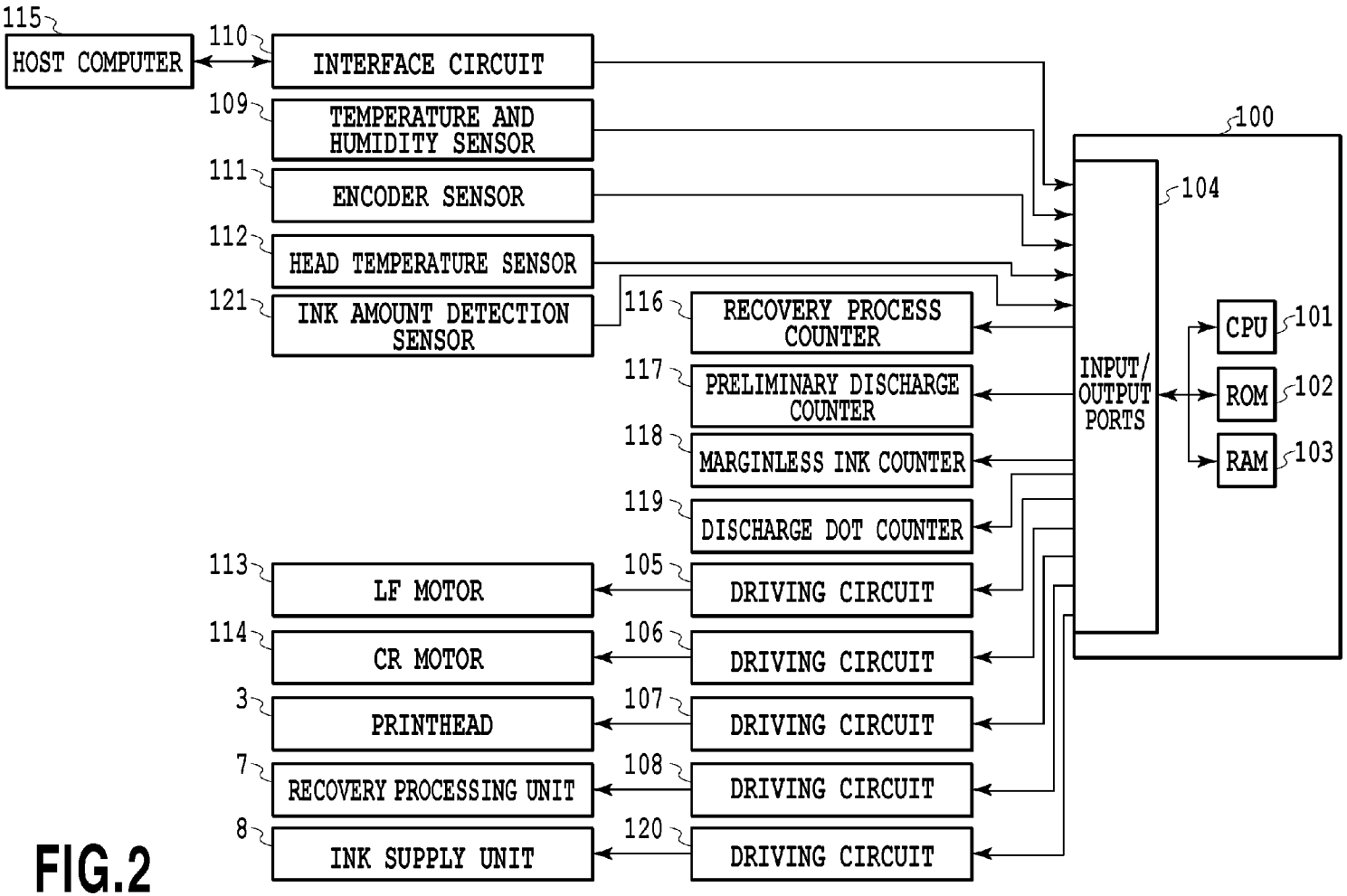
FIG. 2 is a block diagram illustrating the control structure of the printing apparatus.

FIG. 2 is a block diagram illustrating the control configuration of the printing apparatus 1. In this embodiment, a main control unit 100 of the printing apparatus 1 is connected to a host computer 115 through an interface circuit 110. An image is printed on the printing medium 21 on the basis of printing data input from the host computer 115. In addition, printing data may be input to the printing apparatus 1 from, for example, another external storage device. As illustrated in FIG. 2, the main control unit 100 includes a CPU 101, a ROM 102, a RAM 103, and input/output ports 104. The CPU 101 controls the overall operation of the printing apparatus 1. For example, various programs which are executed by the CPU 101 are stored in the ROM 102. The RAM 103 is used as a work area of the CPU 101 and a memory area in which data received by the interface circuit 110 is stored. The input/output ports 104 are used to input and output various kinds of information.

Driving circuits are connected to the input/output ports 104. A driving circuit 105 drives a conveying motor (LF motor 113) of the conveying mechanism. A driving circuit 106 drives a CR motor 114. A driving circuit 107 drives the printhead 3. A driving circuit 108 drives the recovery processing unit 7. A driving circuit 120 drives the ink supply unit 8. A temperature and humidity sensor 109, an encoder sensor 111, a head temperature sensor 112, and an ink amount detection sensor 121 are connected to the input/output ports 104. The temperature and humidity sensor 109 detects temperature or humidity in the usage environment of the printing apparatus 1. The encoder sensor 111 is used to detect the position of the carriage 2. The CPU 101 controls the movement of the carriage 2 on the basis of a detection signal from the encoder sensor 111. The CPU 101 locates the carriage 2 at a home position where the discharging port surface of the printhead 3 is located at a position that faces a cap 19 (which will be described below with reference to FIG. 3) of the recovery processing unit 7 during, for example, a recovery processing operation or a negative pressure generation operation. The head temperature sensor 112 detects the temperature of the printhead 3. The ink amount detection sensor 121 can detect whether a predetermined amount of ink is stored in a reserve tank 10 which will be described below with reference to FIG. 3. The CPU 101 determines whether the reserve tank 10 needs to be filled with ink, on the basis of the determination result of the ink amount detection sensor 121. Detection signals from the sensors are input to the main control unit 100 through the input/output ports 104.

In addition, a recovery process counter 116, a preliminary ejection counter 117, a marginless ink counter 118, and an ejection dot counter 119 are connected to the input/output ports 104. The preliminary ejection counter 117 counts the amount of ink ejected during preliminary ejection. The recovery process counter 116 counts the amount of ink ejected during a recovery process. The marginless ink counter 118 counts the amount of ink ejected to a region other than the printing medium during marginless printing. The ejection dot counter 119 counts the amount of ink ejected during printing.

When printing data is input from the host computer 115 to the main control unit 100, the CPU 101 develops the printing data in a buffer of the RAM 103. The CPU 101 performs driving by the LF motor 113 such that the printing medium 21 is conveyed to a position that faces the discharging ports of the printhead 3 by the conveying mechanism. The CPU 101 performs driving of the CR motor 114 and the printhead 3 such that the carriage 2 is moved and ink is ejected from the discharging ports of the printhead 3. In the printing apparatus 1, an operation of transporting the printing medium 21 in the y direction using the conveying mechanism and an operation of discharging ink from the discharging ports of the printhead 3 with the reciprocation of the carriage 2 in the x direction are repeatedly performed to print an image on the printing medium 21.

Figure 3:
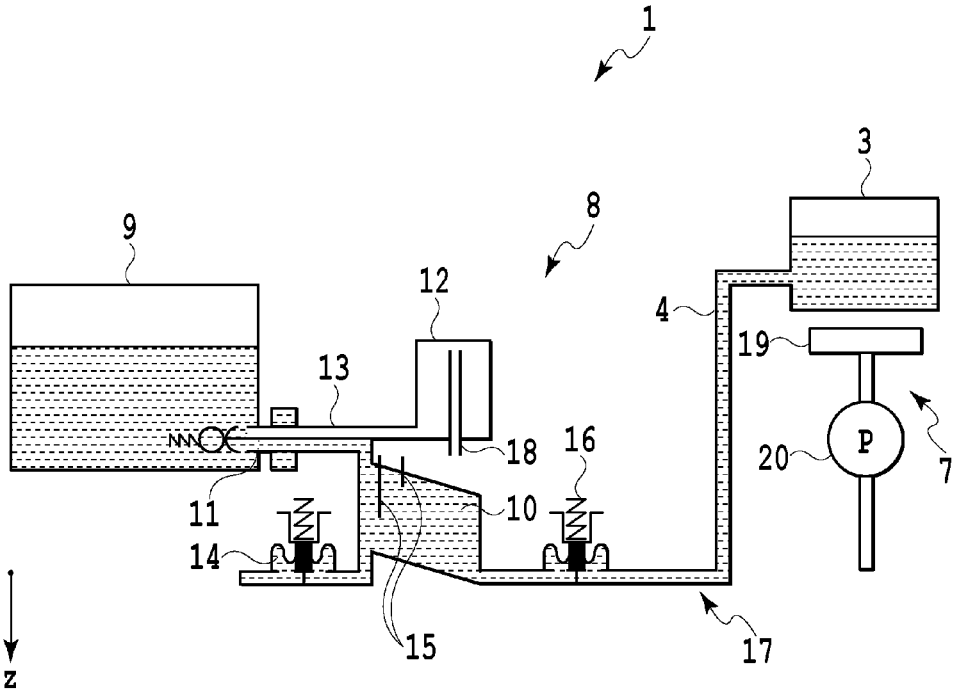
FIG. 3 is a diagram schematically illustrating an ink supply unit, a printhead, and a recovery processing unit.

FIG. 3 is a diagram schematically illustrating the ink supply unit 8, the printhead 3, and the recovery processing unit 7. As illustrated in FIG. 3, the ink supply unit 8 and the printhead 3 are connected to each other by a flow path 17. A portion of the flow path 17 is the supply tube 4 described with reference to FIG. 1.

The ink supply unit 8 includes, for example, an ink tank (maintank) 9, a hollow pipe 11, a reserve tank (subtank) 10, a reserve pump (internal pressure changing member) 14, an electrode pair 15, a valve 16, and a buffer chamber 12. The ink tank 9 is detachably provided in the printing apparatus 1 and is replaceable. For example, in FIGS. 1 and 3, one ink tank is illustrated. However, it is assumed that individual ink tanks are provided for each ink color used by the printing apparatus 1. In addition, it is assumed that the reserve tanks 10 or the supply tubes 4 are provided for each ink color.

The ink tank 9 is configured such that it can store a larger amount of ink than the reserve tank 10. The ink tank 9 and the reserve tank 10 are connected to each other by the hollow pipe 11. The ink tank 9 and the reserve tank 10 are located such that the ink tank 9 is higher than the reserve tank 10 in the direction of gravity (a z direction in FIG. 3). A connection position between the ink tank 9 and the reserve tank 10 is a lower position of the ink tank 9 in the z direction and an upper position of the reserve tank 10 in the z direction.

Ink in the ink tank 9 flows to the reserve tank 10 through the hollow pipe 11. The inside diameter of the hollow pipe 11 has a size to generate flow path resistance to ink and has size to form the meniscus of ink in an opening portion of the hollow pipe 11. In this embodiment, the hollow pipe 11 with an inside diameter of 1 mm is used. However, the inside diameter is not limited thereto.

The reserve tank 10 is fixed at a predetermined position of the printing apparatus 1. The reserve tank 10 is connected to the printhead 3 by the flow path 17. The connection position is a lower position of the reserve tank 10 in the z direction. The valve 16 is provided in the middle of the flow path 17 between the reserve tank 10 and the printhead 3. The valve 16 is opened to open the flow path 17 and is closed to close the flow path 17. In this way, a space in which ink is stored in the ink tank 9 communicates with or does not communicate with a space in which ink is stored in the printhead 3. The valve 16 is formed by a member which can change the volume thereof. In this embodiment, a diaphragm value is used as the valve 16.

The reserve tank 10 is connected to the reserve pump 14. The reserve pump 14 is provided between the valve 16 and the hollow pipe 11. In this embodiment, the reserve pump 14 is connected to the bottom of the reserve tank 10. The reserve pump 14 may be a volume variable member. For example, an elastic member having a diaphragm structure can be used as the reserve pump 14. The volume of the reserve pump 14 is changed to change the internal pressure of the reserve tank 10, thereby supplying ink from the ink tank 9 to the reserve tank 10.

The electrode pair 15 is provided in the reserve tank 10. The electrode pair 15 is provided in an upper part of the reserve tank 10 in the z direction. The electrode pair 15 is electrically connected by a wiring unit (not illustrated). When two electrodes come into contact with ink, a closed circuit is formed. When a predetermined amount of ink is stored in the reserve tank 10, two electrodes forming the electrode pair 15 come into contact with ink and a closed circuit is formed. An electric signal indicating that a predetermined amount of ink is stored in the reserve tank 10 is output. On the other hand, when the amount of ink in the reserve tank 10 does not satisfy a predetermined amount, either or neither of the two electrodes comes into contact with ink and the electrodes are disconnected from each other. The CPU 101 determines whether a process of filling the reserve tank 10 with ink is needed, on the basis of an electric signal output from this circuit. The CPU 101 determines that the process of filling the reserve tank 10 with ink is not needed in a case in which an electric signal indicating that a predetermined amount of ink is stored in the reserve tank 10 is output. In the other cases, the CPU 101 determines that the process of filling the reserve tank 10 with ink is needed. The electrode pair 15 functions as an ink amount detection sensor 121. The ink amount detection sensor 121 is not limited to a sensor using the electrode pair 15 as long as it can detect whether a predetermined amount of ink is stored in the reserve tank 10. In the case illustrated in FIG. 3, two electrodes come into contact with ink, that is, a predetermined amount of ink is stored in the reserve tank 10. Here, a state in which two electrodes come into contact with ink is referred to as a state in which a predetermined amount of ink is stored in the reserve tank 10 and a state in which the filling of the reserve tank 10 with ink has been completed.

The ink tank 9 is connected to the buffer chamber 12 by a communication pipe 13. An atmosphere communication pipe 18 for communicating with atmosphere is provided in the buffer chamber 12. The internal pressure of the ink tank 9 and atmospheric pressure are balanced by this system.

The recovery processing unit 7 includes the cap 19 and a suction pump (negative pressure generation member) 20. During the recovery process, the discharging port surface of the printhead 3 is covered and hermetically sealed by the cap 19. In this state, the suction pump 20 is driven to generate negative pressure in the space closed by the cap 19. In this way, for example, ink which is attached to the discharging port surface or high viscosity ink which is in the discharging port and a flow path connected to the discharging port and whose viscosity has increased is sucked. The sucked ink is stored in a waste ink container (not illustrated). Also in the printhead filling operation, the discharging port surface of the printhead 3 is covered by the cap 19 and the suction pump 20 is driven to generate negative pressure.

The CPU 101 controls the driving of the reserve pump 14 and the opening and closing of the valve 16 in the ink supply unit 8 through the driving circuit 120. In addition, the CPU 101 controls the contact and separation of the cap 19 and the driving of the suction pump 20 in the recovery processing unit 7 through the driving circuit 108.

<Ink Supply Method in State in which Ink is Stored in Ink Tank 9>

An ink supply method in a case in which ink is stored in the ink tank 9 and the reserve tank 10 and a predetermined amount of ink is stored in the reserve tank 10 will be described. When the amount of ink in the printhead 3 is reduced due to the ejection of ink from the discharging ports of the printhead 3, negative pressure is generated in the reserve tank 10 through the supply tube 4 which connects the printhead 3 and the reserve tank 10. When the negative pressure exceeds the flow path resistance and the meniscus withstanding pressure in the hollow pipe 11, ink is supplied from the ink tank 9 to the reserve tank 10 and is supplied from the reserve tank 10 to the printhead 3. In this way, ink corresponding to the amount of ink which has been ejected from the discharging ports of the printhead 3 is supplied from the ink tank 9 to the printhead 3. When negative pressure is generated in the ink tank 9 by the supply of the ink, air or ink is moved from the buffer chamber 12 to the ink tank 9 through the communication pipe 13 to remove the negative pressure of the ink tank 9.

When there is no ink in the ink tank 9, the ink tank 9 is replaced. When the ink tank 9 is replaced, a standard amount of ink is stored in the reserve tank 10 such that a printing operation on at least one relatively large printing medium is not stopped. The standard amount of ink means the amount of ink required to complete the printing of an image on at least one relatively large printing medium at 100 percent of printing duty. Here, when the amount of ink in the reserve tank 10 is less than the standard amount during the replacement of the ink tank 9, a printing operation on one printing medium does not start. Whether the amount of ink stored in the reserve tank 10 is the standard amount is determined on the basis of the count values from the recovery process counter 116, the preliminary ejection counter 117, the marginless ink counter 118, and the ejection dot counter 119. The CPU 101 determines whether a standard amount of ink is stored in the reserve tank 10 on the basis of the count values from the recovery process counter 116, the preliminary ejection counter 117, the marginless ink counter 118, and the ejection dot counter 119 after the filling of the reserve tank 10 with ink is completed. Therefore, it is possible to prevent, for example, the unevenness of ink concentration assumed when a printing operation on one printing medium is temporarily stopped during the replacement of the ink tank 9 and is resumed after the ink tank 9 is replaced.

<Method for Supplying Ink to Reserve Tank 10 after Ink Tank 9 is Replaced>

In a state in which there is no ink in the ink tank 9 or a state in which the ink tank 9 is detached from the printing apparatus 1, ink in the reserve tank 10 is consumed and the amount of ink in the reserve tank 10 is less than a predetermined amount. A method for filling the reserve tank 10 with ink in this case will be described with reference to FIGS. 4A to 4C and FIG. 5.

Figure 4A:
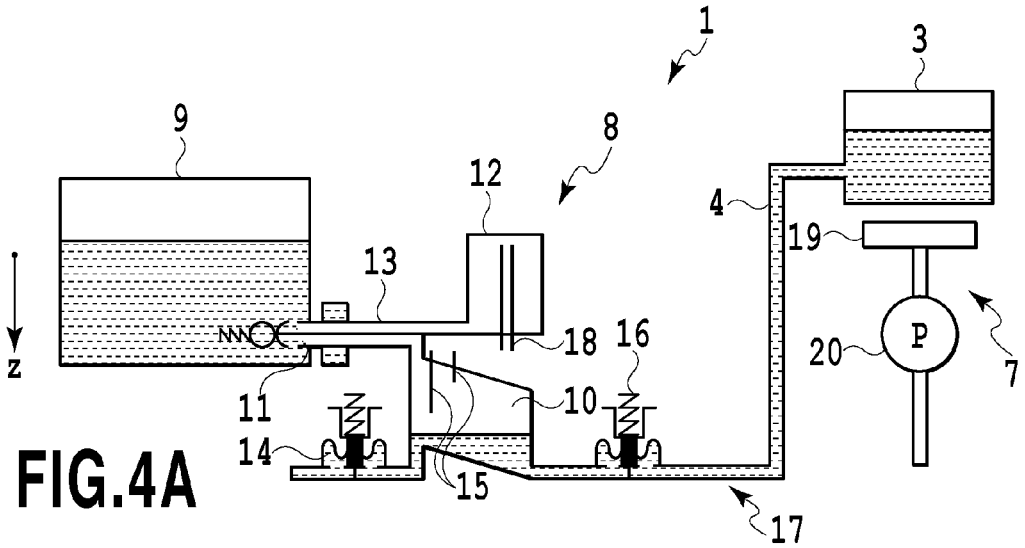
FIGS. 4A to 4C are diagrams schematically illustrating a reserve tank filling method.
Figure 4B:
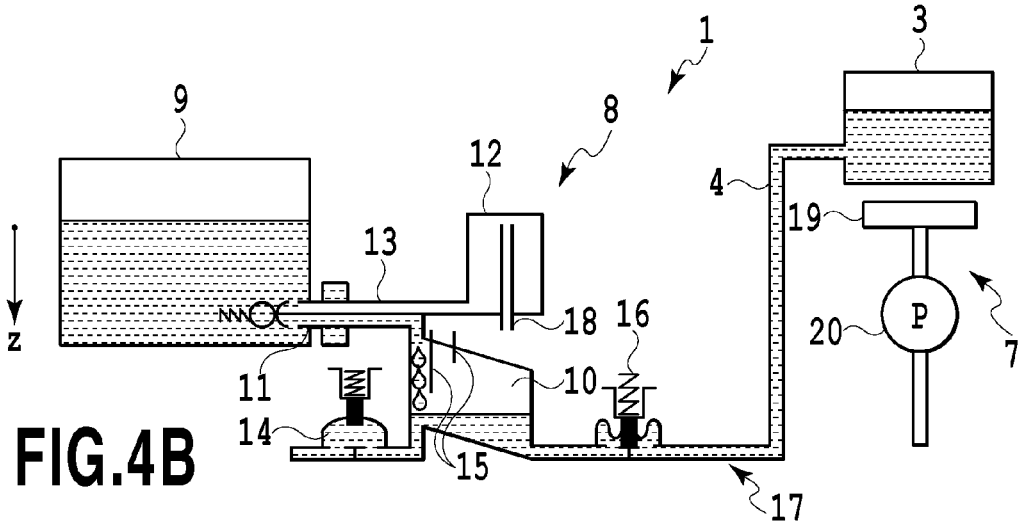
Figure 4C:
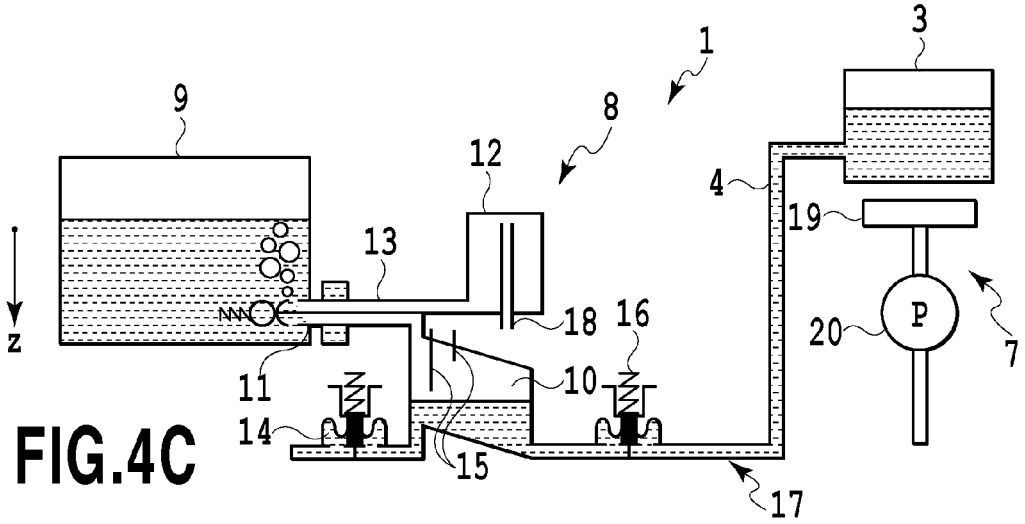
Figure 5:
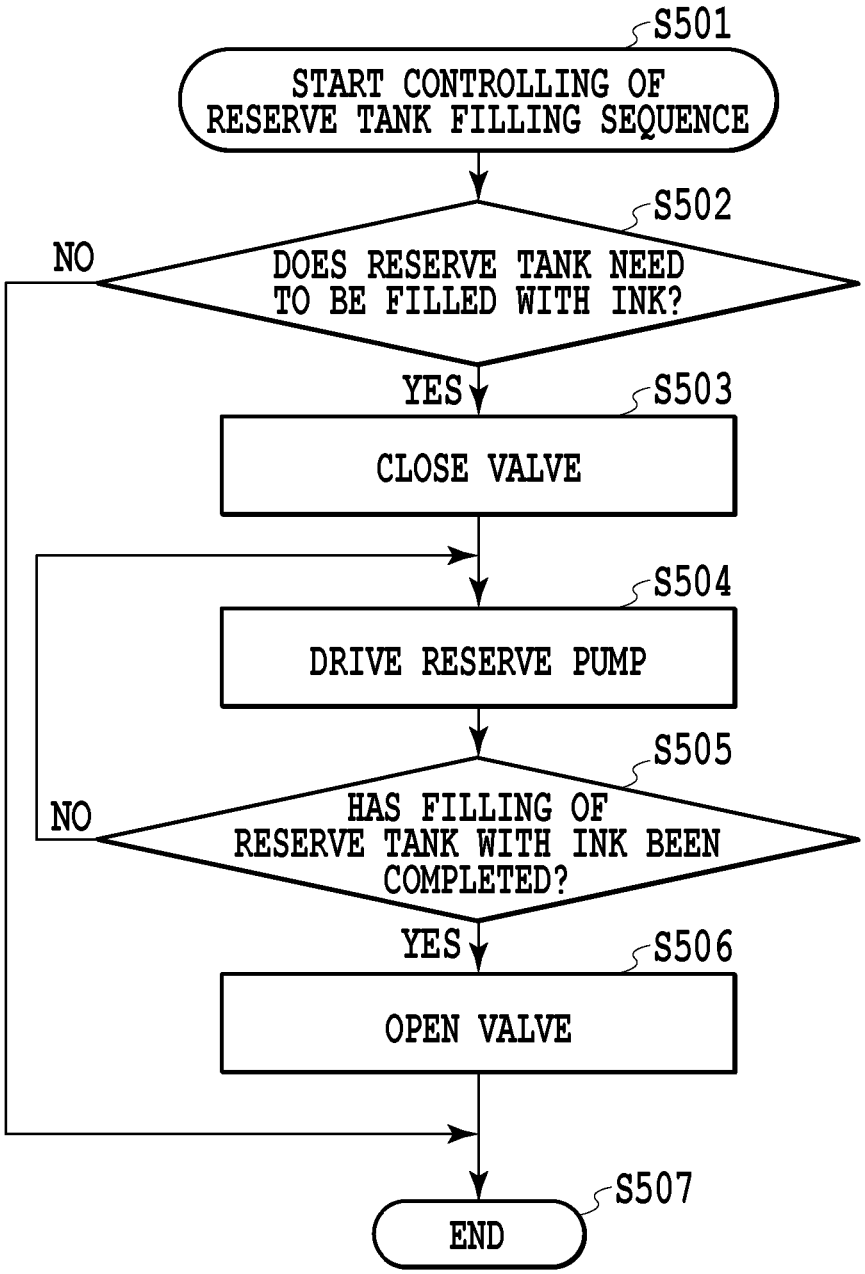
FIG. 5 is a flowchart illustrating a reserve tank filling sequence.

FIG. 4A illustrates a state in which after the amount of ink in the reserve tank 10 is less than a predetermined amount, the ink tank 9 has been replaced. FIG. 4B illustrates a state in which the volume of the reserve pump 14 is expanded. FIG. 4C illustrates a state in which the volume of the reserve pump 14 is contracted. FIG. 5 is a flowchart illustrating the sequence of filling the reserve tank 10 with ink.

As illustrated in FIG. 5, when detecting that the ink tank 9 has been replaced, the CPU 101 starts controlling of the sequence of filling the reserve tank 10 with ink (S501). The CPU 101 determines whether the reserve tank 10 needs to be filled with ink on the basis of the detection result of the ink amount detection sensor 121 (S502). Specifically, the CPU 101 determines whether an electric signal value from the ink amount detection sensor 121 is greater than a predetermined value. When a signal level is equal to or less than a predetermined value, the CPU 101 determines that the electrode pair 15 has come into contact with ink and a predetermined amount of ink has been stored in the reserve tank 10. Hereinafter, the signal level equal to or less than a predetermined value means that a predetermined amount of ink is stored in the reserve tank 10 and it is not necessary to fill the reserve tank 10 with ink. The signal level greater than a predetermined value means that a predetermined amount of ink is not stored in the reserve tank 10, the filling of the reserve tank 10 with ink has not been completed, and it is necessary to fill the reserve tank 10 with ink. The process of determining whether the reserve tank 10 needs to be filled with ink in this step is completed within about one second.

When determining that the reserve tank 10 does not need to be filled with ink (NO in S502), the CPU 101 ends the process (S507). When it is determined that the reserve tank 10 needs to be filled with ink (YES in S502) and the valve 16 is in an open state, the CPU 101 makes the valve 16 closed (S503). This state is illustrated in FIG. 4A. As illustrated in FIG. 4A, the valve 16 is closed to block the flow path 17. In this state, the reserve pump 14 is contracted.

Then, the reserve pump 14 is driven (S504). Here, an operation of expanding and contracting the reserve pump 14 once a second is set so as to be repeated five times. This driving of the reserve pump 14 allows ink supplied from the ink tank 9 to the reserve tank 10. When the volume of the reserve pump 14 is expanded as illustrated in FIG. 4B, the internal pressure of the reserve tank 10 which communicates with the reserve pump 14 is reduced and a pressure difference between the ink tank 9 and the reserve tank 10 occurs. In order to remove the pressure difference, the internal pressure value of the reserve tank 10 returns to a pressure value in the state in which the reserve pump 14 is contracted. Then, ink flows from the ink tank 9 to the reserve tank 10. Here, it is assumed that the volume of the reserve tank 10 is 15 ml and the amount of change in the volume of the reserve pump 14 is 1 ml. In addition, it is assumed that the amount of change in the internal pressure of the reserve tank 10 caused by a change in the volume of the reserve pump 14 is greater than the meniscus force of the hollow pipe 11.

After a predetermined period of time has elapsed since the expansion of the volume of the reserve pump 14, the volume of the reserve pump 14 is contracted as illustrated in FIG. 4C. When the volume of the reserve pump 14 is contracted, the internal pressure of the reserve tank 10 increases. The increased internal pressure value of the reserve tank 10 tends to return to the pressure value when the reserve pump 14 is expanded, and therefore air in the reserve tank 10 moves to the ink tank 9.

After a predetermined period of time has elapsed since the contraction of the volume of the reserve pump 14, the volume of the reserve pump 14 is expanded again to make ink flow from the ink tank 9 to the reserve tank 10. The operation of expanding and contracting the volume of the reserve pump 14 is repeated to exchange air in the reserve tank 10 with ink in the ink tank 9, thereby filling the reserve tank 10 with ink.

When the reserve pump 14 is driven with the valve 16 closed, the internal pressure difference between the reserve tank 10 and the ink tank 9 caused by a change in the volume of the reserve pump 14 can be relatively large. When the reserve pump is driven with the valve 16 open, a change in the internal pressure of the reserve tank 10 caused by a change in the volume of the reserve pump 14 is transmitted to the printhead 3. Therefore, in the case that a relatively large change in pressure occurs, the meniscus of the discharging ports of the printhead 3 is broken. As a result, for example, the mixture of air from the discharging ports or the leakage of ink from the discharging ports occurs. In this embodiment, since the operation of filling the reserve tank 10 with ink is performed with the valve 16 closed, the above-mentioned problems are prevented.

The internal pressure value of the reserve tank 10 may vary depending on the amount of change in the volume of the reserve pump 14 and a volume change speed. The amount of change in the volume and the volume change speed are determined such that the driving of the reserve pump which generates a pressure for opening the valve 16 is avoided. The reserve pump 14 preferably has a structure in which the amount of change in volume is relatively large and the amount of ink moved by one pump driving operation is relatively large. However, the structure of the reserve pump 14 is determined considering, for example, influence on the valve 16, an increase in the size of the body of the printing apparatus 1, and costs.

The CPU 101 determines whether the reserve tank 10 has been filled with a predetermined amount of ink (S505). When determining that the reserve tank 10 has not been filled with a predetermined amount of ink (NO in S505), the CPU 101 makes the reserve pump 14 driven again (S504). When determining that the reserve tank 10 has been filled with a predetermined amount of ink (YES in S505), the CPU 101 makes the valve 16 closed since the filling of the reserve tank 10 with ink has been completed (S506). Then, the CPU 101 ends the process (S507).

<Method for Filling Printhead 3 with Ink>

A method for filling the printhead 3 with ink will be described. The printhead 3 is filled with ink, for example, at the time of initial filling when the printing apparatus 1 is initially used, when the printhead 3 is replaced with a new one while the printing apparatus 1 is being used, and when air flows into the printhead 3 for any reason while the printhead 3 is being used. For example, the control of an ink filling sequence when air flows into the printhead 3 while the printhead 3 is being used starts in response to, for example, an instruction from the user. Here, a method for filling the printhead 3 with ink when the printhead 3 is replaced will be described.

Figure 6:
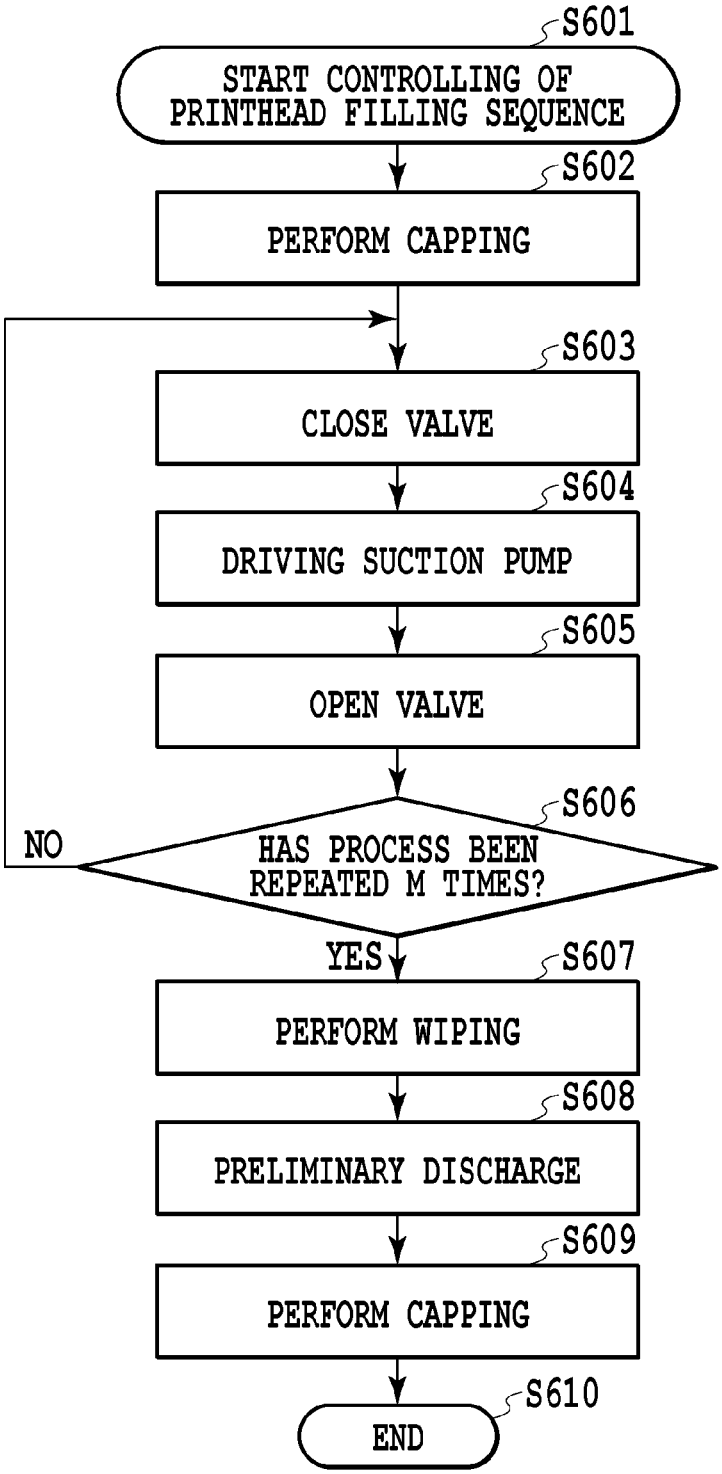
FIG. 6 is a flowchart illustrating a printhead filling sequence.

FIG. 6 is a flowchart illustrating the sequence of filling the printhead 3 with ink when the flow path 17 or the reserve tank 10 has been filled with ink (in a case other than initial filling). When detecting that the printhead 3 has been replaced, the CPU 101 starts controlling of the sequence for filling the printhead 3 with ink (S601). The CPU 101 performs a capping operation of tightly covering the discharging port surface of the printhead 3 with the cap 19 (S602).

Then, when the valve 16 is opened, the CPU 101 makes the valve 16 closed (S603) to block the flow path 17. Then, the CPU 101 drives the suction pump 20 (S604). The suction pump 20 is driven to suck, for example, air in a flow path from the position of the valve 16 to the position of the cap 19 and to generate a negative pressure in a flow path from the valve 16 to the printhead 3 and in the printhead 3. Here, the suction pump 20 is driven for 90 seconds. The volume of the printhead 3 is 5 ml and the suction pump is driven for 90 seconds to generate a negative pressure of about −60 kPa to −90 kPa in the printhead 3.

The CPU 101 makes the valve 16 opened (S605) such that the ink tank 9 and the reserve tank 10 communicate with the printhead 3 and ink flows into the printhead 3. In this embodiment, a process from S603 to S605 is performed M times to fill the printhead 3, which has not been filled with ink, with a desired amount of ink. In this method, the number of times the process is repeated is set to 3. For example, a waiting time may be provided after the valve 16 is opened in S605 in order to wait for the completion of the movement of ink after the valve 16 is opened.

In this embodiment, the printhead 3 has a relatively large volume of 5 ml. Therefore, when the suction pump 20 is driven with the valve 16 open, ink flows into the printhead 3, but it takes a relatively long time to fill the printhead 3 with a desired amount of ink. For this reason, in this embodiment, after a certain level of negative pressure is generated in the printhead 3 with the valve 16 closed, the valve 16 is opened.

The CPU 101 determines whether the process from S603 to S605 has been performed M times (S606). When determining that the process has not been performed M times (NO in S606), the CPU 101 returns to S603. When determining that the process has been performed M times (YES in S606), the CPU 101 makes the cap 19 separated from the printhead 3 and performs a wiping operation of wiping the discharging port surface of the printhead 3 with a blade (not illustrated) (S607) to clean the discharging port surface of the printhead 3. In some cases, for example, a foreign material attached to the discharging port surface enters the printhead 3 through the discharging ports due to the wiping operation in S607. Therefore, in this embodiment, a preliminary ejection process of discharging ink which does not contribute to forming an image from the discharging ports of the printhead 3 is performed (S608).

The CPU 101 makes the printhead 3 covered with the cap 19 in order to prevent ink in the discharging ports or in the vicinity of the discharging ports from being dried (S609) and ends the process (S610). When the printhead 3 is filled with ink while being used, it is considered that a certain amount of ink is stored in the printhead 3 and the number of times the driving of the suction pump 20 is repeated can be less than that when the printhead 3 is replaced. In addition, when the cap 19 receives ink which is preliminarily ejected from the printhead 3, the suction pump 20 may be driven to eject ink onto the cap 19 before the capping operation in S609 and then the capping operation in S609 may be performed.

<Initial Filling Method>

Figure 7:
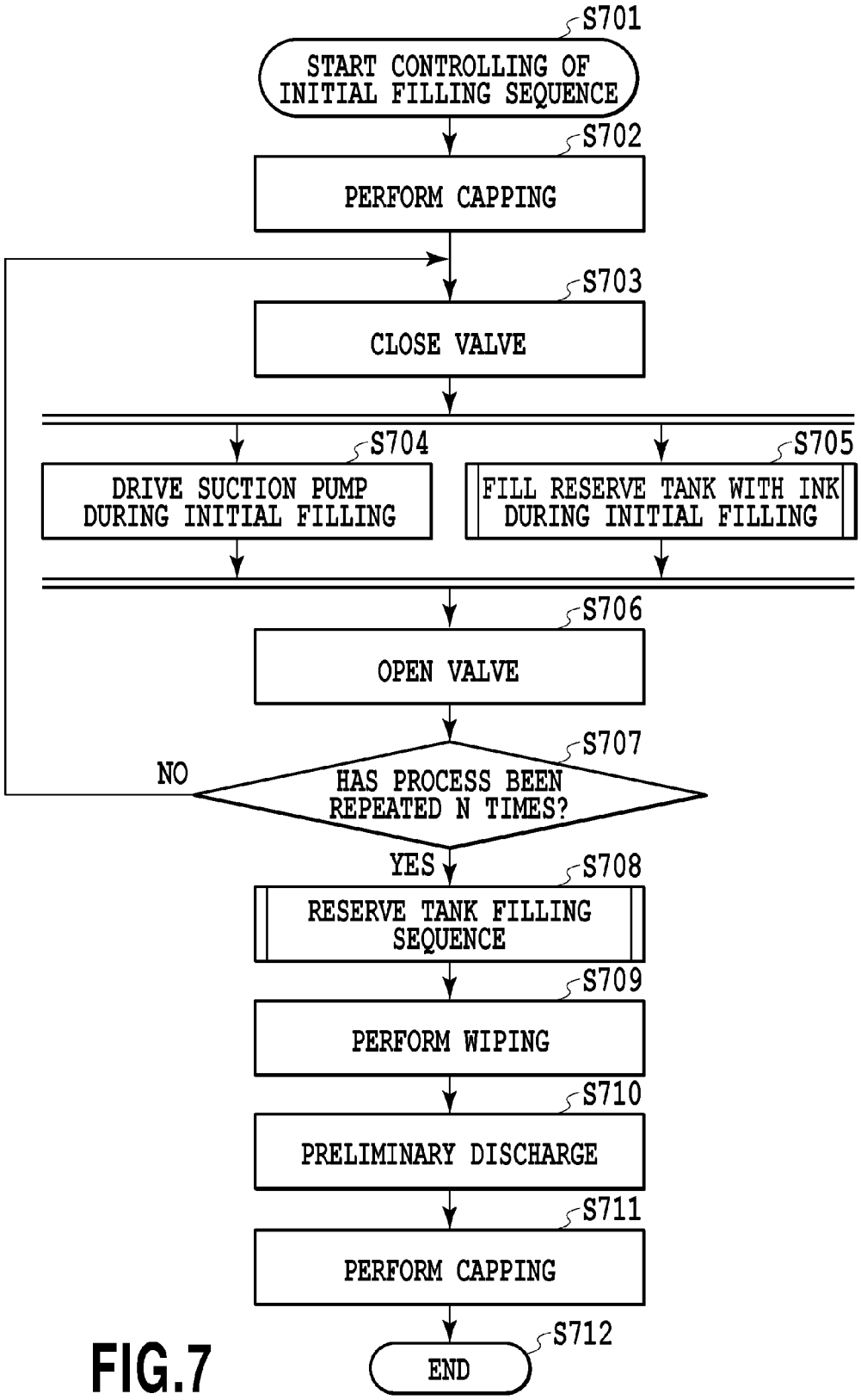
FIG. 7 is a flowchart illustrating an initial filling sequence.

An initial filling method which is a characteristic method according to this embodiment will be described. Here, the initial filling means that ink is initially supplied from the ink tank 9 to the reserve tank 10 and the printhead 3 which have not been filled with ink and fills the reserve tank 10 and the printhead 3. FIG. 7 is a flowchart illustrating an initial filling sequence. FIGS. 10A to 10D are diagrams schematically illustrating the ink filling method during initial filling. In a state before initial filling, no ink is stored in the reserve tank 10, the flow path 17, and the printhead 3. The ink tank 9 having ink stored therein is mounted on the printing apparatus 1 in this state and an initial filling operation starts. When detecting that the ink tank 9 having ink stored therein has been mounted on the printing apparatus 1 before initial filling, the CPU 101 starts controlling of an initial filling sequence (S701). The discharging port surface is covered with the cap 19 (S702) and the valve 16 is closed (S703) to block the flow path 17. The printing apparatus 1 is in the state illustrated in FIG. 10A through the above-mentioned process. Then, the driving of the suction pump 20 (S704) and the filling of the reserve tank 10 with ink (S705) are performed at the same time.

Figure 8:
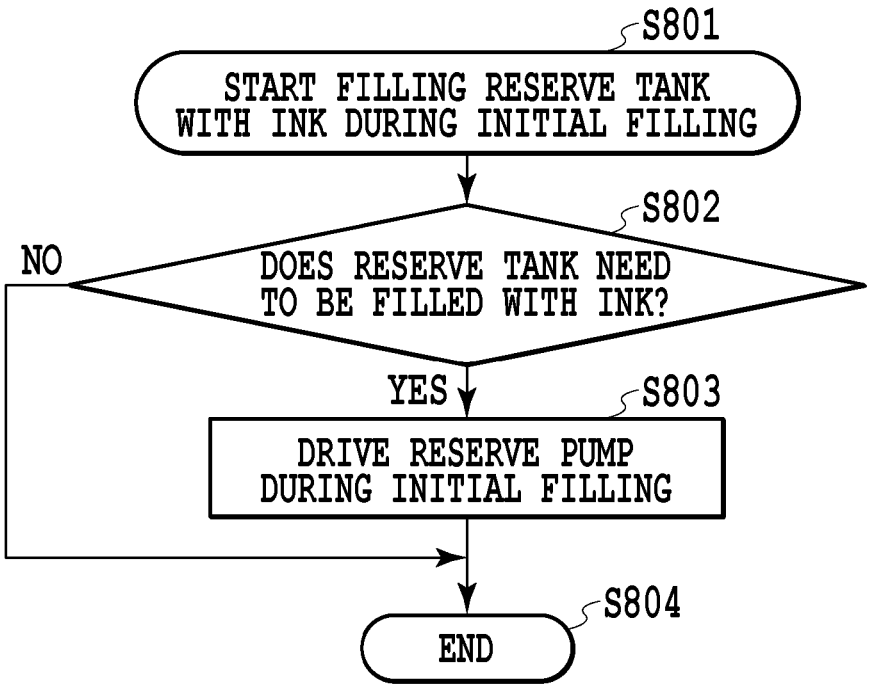
FIG. 8 is a flowchart illustrating a reserve tank filling process during initial filling.

FIG. 8 is a flowchart illustrating a process of filling the reserve tank 10 with ink during initial filling in S705 of FIG. 7. When the process of filling the reserve tank 10 with ink during initial filling starts (S801), the CPU 101 determines whether the reserve tank 10 needs to be filled with ink (S802). Since the process from S703 to S706 of FIG. 7 is repeated N times, this step is provided in order to determine whether the filling of the reserve tank 10 with ink has been completed while the operation is being repeated, which will be described in detail below. When determining that the reserve tank 10 needs to be filled with ink (YES in S802), the CPU 101 makes the reserve pump 14 driven (S803). Then, similarly to the method described in S504 of FIG. 5, ink is supplied from the ink tank 9 to the reserve tank 10 and the process ends (S804). When determining that the reserve tank 10 does not need to be filled with ink (NO in S802), the CPU 101 ends the process (S804).

Figure 9:
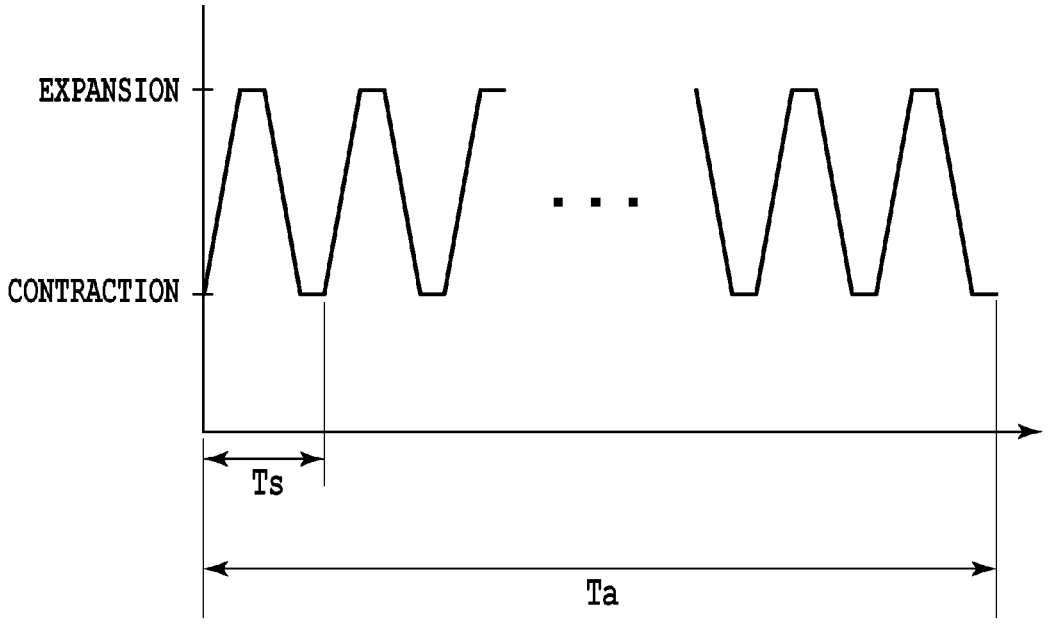
FIG. 9 is a graph illustrating the driving of a reserve pump during initial filling.

FIG. 9 is a graph illustrating the state of the reserve pump 14 which is driven during initial filling in S803 of FIG. 8. In FIG. 9, the horizontal axis indicates time and the vertical axis indicates the state of the reserve pump 14. As illustrated in FIG. 9, here, an operation of expanding the contracted volume of the reserve pump 14 and then contracting the volume of the reserve pump is performed within a period Ts. In addition, this operation is continuously performed for a period Ta. Here, the reserve pump 14 is driven under the conditions of a period Ts of 1.5 seconds and a period Ta of 84 seconds.

During initial filling, an operation of changing the volume of the reserve pump 14 is performed with a period of 1.5 seconds. In contrast, during operations other than initial filling, an operation of changing the volume of the reserve pump 14 is performed with a period of 1 second. As such, the driving speed of the reserve pump 14 is different between the initial filling and the other operations. During initial filling, since the driving of the suction pump 20 is performed in parallel to the driving of the reserve pump 14, in some cases, a relatively loud driving sound is generated by the two driving operations. Therefore, during the initial filling, the driving speed of the reserve pump 14 is reduced, as compared to operations other than the initial filling. As a result, a driving sound during initial filling is suppressed.

Figure 10A:
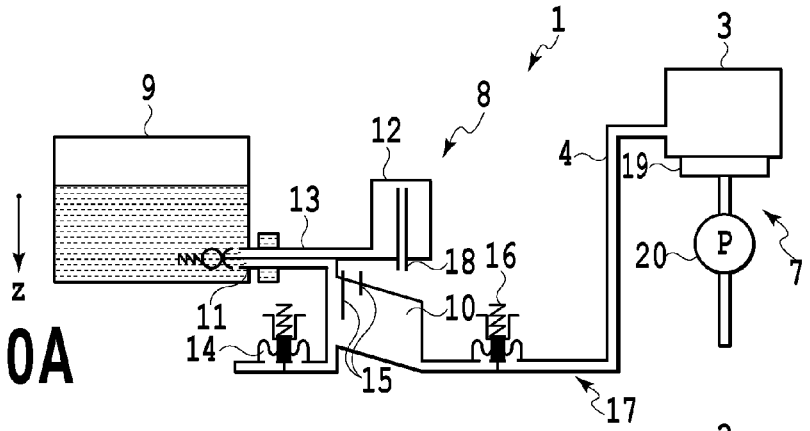
FIGS. 10A to 10D are diagrams schematically illustrating a filling method during initial filling.
Figure 10B:
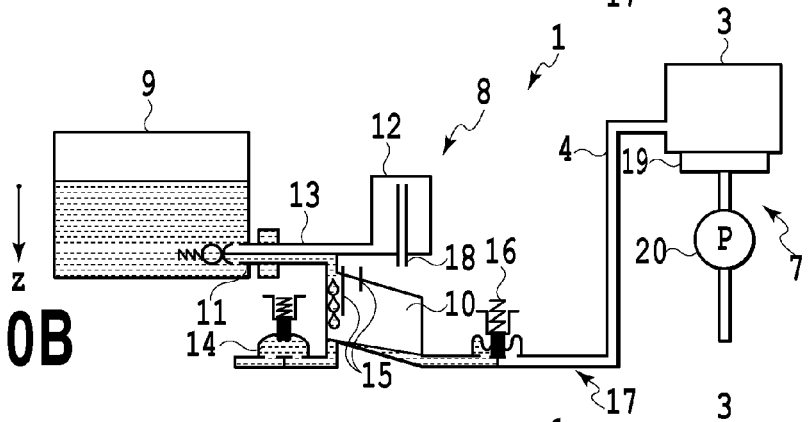
Figure 10C:
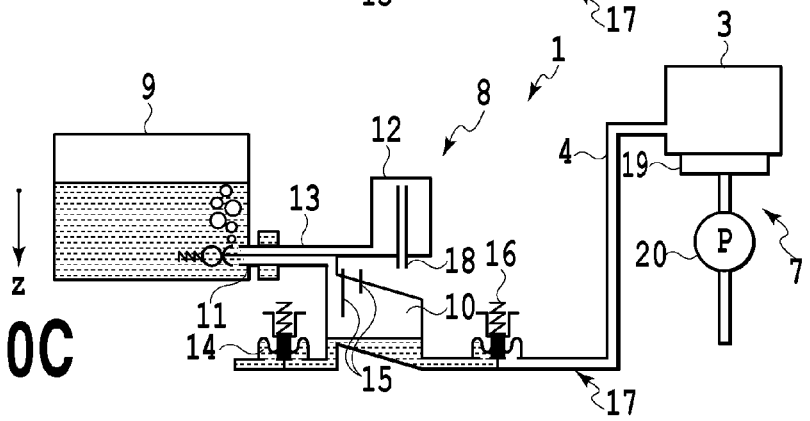

FIG. 10B illustrates a state in which the volume of the reserve pump 14 is expanded. FIG. 10C illustrates a state in which the volume of the reserve pump 14 is contracted. The contraction and expansion of the volume of the reserve pump 14 are repeated to supply ink from the ink tank 9 to the reserve tank 10.

FIG. 7 is referred to again. Here, the driving time of the suction pump 20 in S704 is 90 seconds and the reserve tank filling operation (subtank filling operation) during initial filling in S705, which includes an operation of checking whether the reserve tank 10 needs to be filled with ink, is completed within 85 seconds. Therefore, the operation of filling the reserve tank 10 with ink ends before the driving of the suction pump 20 is stopped. Here, while the reserve pump 14 is being driven, the suction pump 20 is also driven and negative pressure is generated in a space from the printhead 3 to the valve 16. Therefore, in this structure, even if the internal pressure of the reserve tank 10 is changed due to a change in the volume of the reserve pump 14, the valve 16 is less likely to be opened than that in a structure in which negative pressure is not generated in the space from the printhead 3 to the valve 16.

Figure 10D:
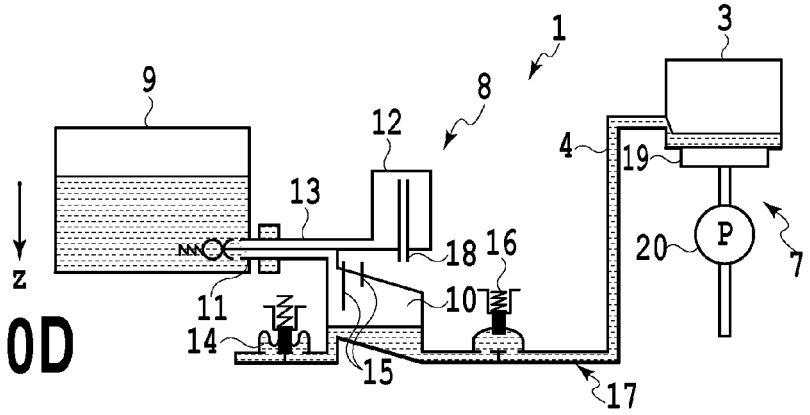

After the driving of the suction pump 20 ends, the valve 16 is opened (S706). FIG. 10D illustrates a state in which the valve 16 is opened. As illustrated in FIG. 10D, when the valve 16 is opened, ink in the ink tank 9 and the reserve tank 10 is supplied into the printhead 3 through the flow path 17. Here, it takes about 7 seconds until the movement of ink is completed after the valve 16 is opened. Therefore, an operation of waiting for 7 seconds until the process proceeds to the next step after S706 ends is provided. The presence or absence of the waiting time or the duration of the waiting time is appropriately set according to, for example, the structure of the printing apparatus 1.

Here, the volume of the flow path 17 is about 5 ml and the volume of the printhead 3 is 5 ml and it is difficult to fill the flow path 17 and the printhead 3 with a desired amount of ink, using one suction process of driving the suction pump 20 for 90 seconds. Therefore, here, the process from S703 to S706 is performed N times to fill the flow path 17 and the printhead 3 with a desired amount of ink. Here, the number of times the process is repeated is set to 5.

The CPU 101 determines whether the process from S703 to S706 has been performed N times (S707). When determining that the process from S703 to S706 has not been performed N times (NO in S707), the CPU 101 returns to S703 again. When determining that the process from S703 to S706 has been performed N times (YES in S707), the CPU 101 controls the reserve tank filling sequence with reference to FIG. 5 (S708). Here, the process from S703 to S706 is repeated five times. An experiment showed that the filling of the reserve tank 10 with ink was completed before the fourth filling operation started. In this case, in the reserve tank filling process during initial filling in S705, it is determined that the fourth and fifth operations of filling the reserve tank 10 with ink in S802 of FIG. 8 are not needed. Therefore, the reserve pump 14 is not driven. However, the amount of ink supplied is reduced due to a change in the volume of the reserve pump 14, according to a variation in the members in the body of the printing apparatus 1, such as the amount of change in the volume of the reserve pump 14 or the volume of the reserve tank 10, or the installation environment of the printing apparatus 1, which results in a reduction in supply efficiency. Therefore, only the operation from S703 to S706 is insufficient to fill the reserve tank 10 with a desired amount of ink. For this reason, here, after the process from S703 to S706 is performed N times, a process of controlling the reserve tank filling sequence is performed (S708).

After the filling of the reserve tank 10 with ink is completed, the cap 19 is separated from the printhead 3 and a wiping operation of wiping the discharging port surface of the printhead 3 with a blade (not illustrated) is performed (S709). Then, preliminary ejection of ink is performed from the discharging port of the printhead 3 (S710) and the printhead 3 is covered with the cap 19 (S711). Then, the process ends (S712).

As described above, in this embodiment, the suction operation which generates desired negative pressure in the flow path 17 and the printhead 3 is synchronized with the operation which fills the reserve tank 10 with ink. Therefore, it is possible to reduce an initial filling time, as compared to a case in which the operation which generates desired negative pressure in the flow path 17 and the printhead 3 is performed and then the operation which fills the reserve tank 10 with ink is performed. In the above-mentioned experiment, the filling of the reserve tank 10 with ink was completed when the process from S703 to S706 of FIG. 7 was repeated three times. Therefore, an operation which drives the suction pump 20 for 90 seconds and an operation which fills the reserve tank 10 with ink (drives the reserve pump 14) for 84 seconds are repeated two or three times to complete the filling of the reserve tank 10 with ink. Assuming that the suction pump 20 is driven to generate negative pressure in the printhead 3 and then the reserve tank 10 is filled with ink, an operation which drives the suction pump 20 for 90 seconds and then drives the reserve pump 14 for 84 seconds, that is, an operation which is performed for 174 seconds is performed two or three times. In this embodiment, it is possible to reduce the initial filling time by about 168 seconds to 252 seconds, as compared to the above-mentioned case.

As described above, in this embodiment, it is possible to reduce the ink filling time in the initial state. Therefore, it is possible to reduce the time until an image printing operation starts after the ink tank 9 is mounted on the printing apparatus 1 in the initial state.

Second Embodiment

A second embodiment differs from the first embodiment in an operation of driving the suction pump 20 during initial filling and an operation of filling the reserve tank 10 with ink during initial filling. The other structures are the same as those in the first embodiment and thus the description thereof will not be repeated.

<Initial Filling Method>

Figure 11:
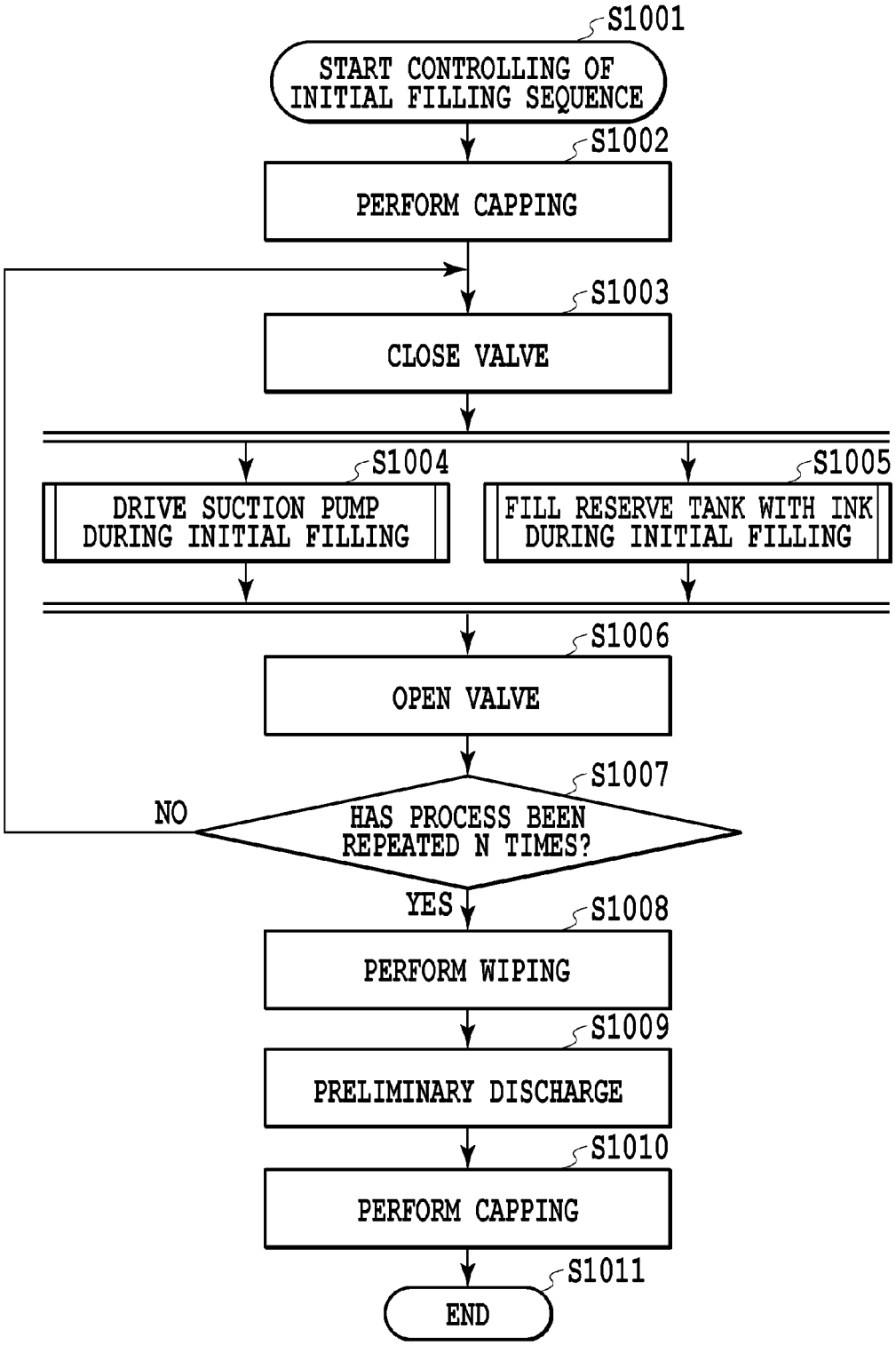
FIG. 11 is a flowchart illustrating an initial filling sequence according to a second embodiment.

FIG. 11 is a flowchart illustrating an initial filling sequence. Since S1001 to 1003 in FIG. 11 are the same as S701 to S703 in FIG. 7, S1006 in FIG. 11 is the same as S706 in FIG. 7, and S1008 to S1011 in FIG. 11 are the same as S709 to S712 in FIG. 7, the description thereof will not be repeated. Also in this embodiment, after a valve 16 is closed (S1003), the driving of a suction pump 20 (S1004) and the filling of a reserve tank 10 with ink (S1005) are performed at the same time. In this embodiment, in S1104 of FIG. 12 which will be described below, it is determined whether the filling of the reserve tank 10 with ink has been completed. Therefore, in FIG. 11, a step corresponding to S708 in FIG. 7 is not provided.

Figure 12:
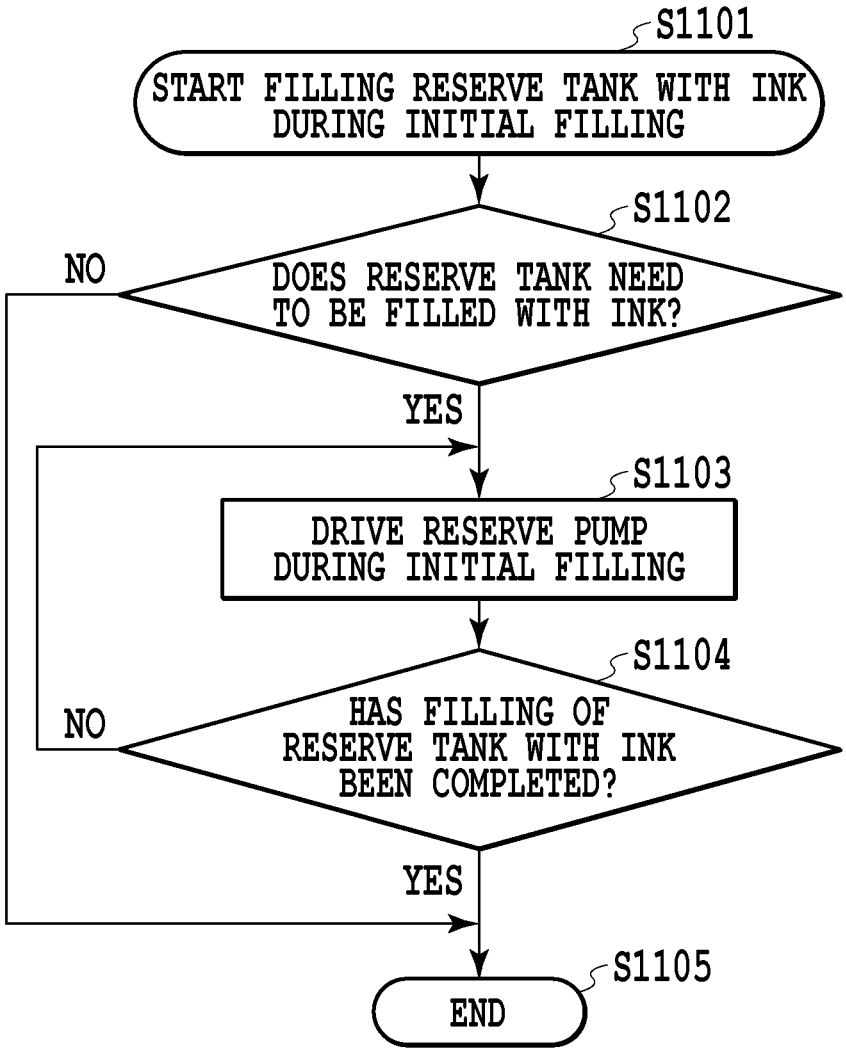
FIG. 12 is a flowchart illustrating a reserve tank filling process during initial filling.

FIG. 12 is a flowchart illustrating a process of filling the reserve tank 10 with ink during initial filling in S1005 of FIG. 11. When the process of filling the reserve tank 10 with ink during initial filling starts (S1101), the CPU 101 determines whether the reserve tank 10 needs to be filled with ink (S1102). When determining that the reserve tank 10 needs to be filled with ink (YES in S1102), the CPU 101 makes a reserve pump 14 driven (S1103). Here, a period Ts is 1.5 seconds, a period Ta is 7.5 seconds, and an operation of expanding and contracting the reserve pump 14 is repeated five times. When determining that the reserve tank 10 does not need to be filled with ink (No in S1102), the CPU 101 ends the process (S1105). The CPU 101 determines whether the reserve tank 10 has been filled with a predetermined amount of ink (S1104). When determining that the reserve tank 10 has not been filled with a predetermined amount of ink (NO in S1104), the processing returns to S1103. When determining that the reserve tank 10 has been filled with a predetermined amount of ink (YES in S1104), the CPU 101 ends the process since the filling of the reserve tank 10 with ink has been completed (S1105).

Figure 13:
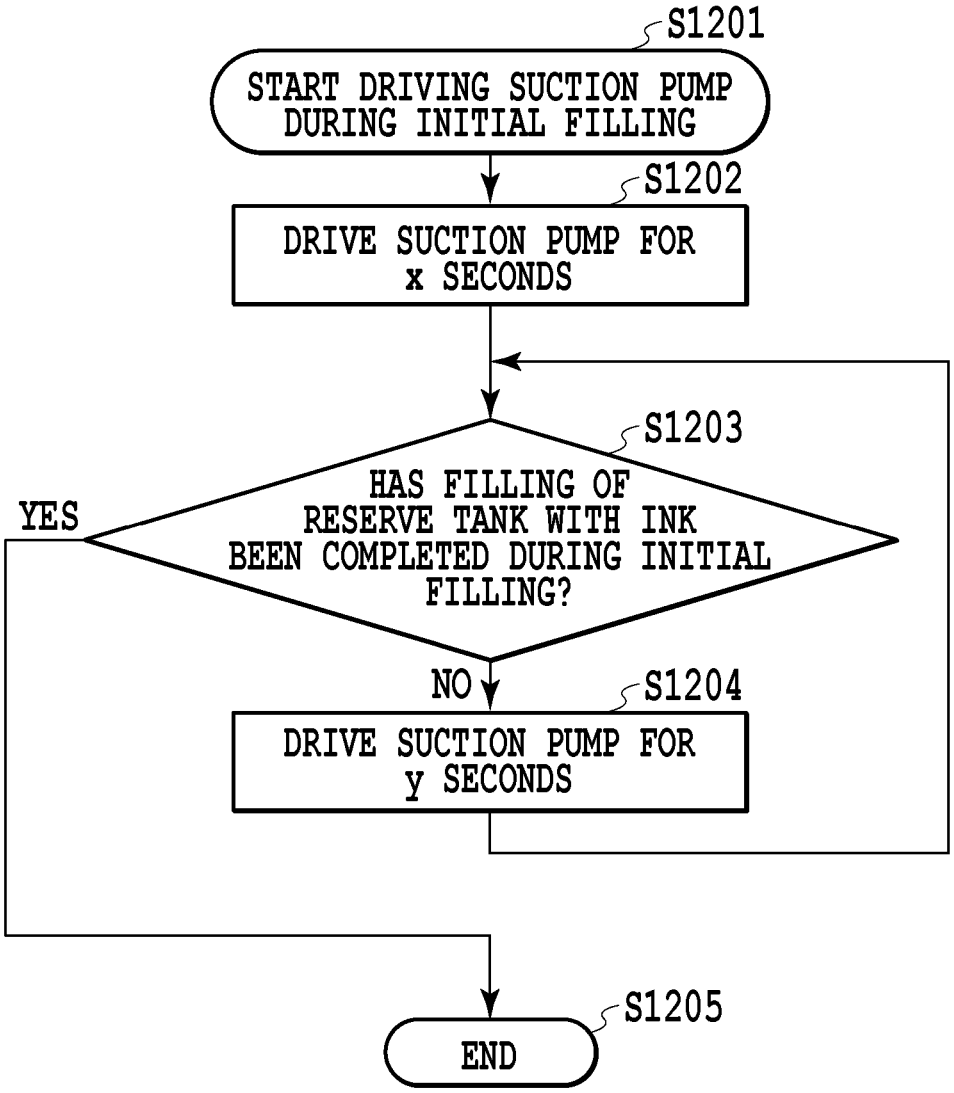
FIG. 13 is a flowchart illustrating the driving of a suction pump during initial filling.

FIG. 13 is a flowchart illustrating the driving of the suction pump 20 during initial filling in S1004 of FIG. 11. When the driving of the suction pump 20 during initial filling starts (S1201), the CPU 101 makes the suction pump 20 driven for x seconds (S1202). Here, the CPU 101 makes the suction pump 20 driven for 90 seconds. After driving the suction pump 20 for x seconds, the CPU 101 determines whether the process in S1005 of FIG. 11 has been completed (S1203). Here, the time until the filling of the reserve tank 10 with ink during initial filling in S1005 of FIG. 11 is completed was 180 seconds. When determining that the process in S1005 has not been completed (NO in S1203), the CPU 101 makes the suction pump 20 driven for y seconds (S1204) and returns to S1203. Here, the CPU 101 makes the suction pump 20 driven for 5 seconds. When determining that the process in S1005 has been completed (YES in S1203), the CPU 101 ends the process (S1205).

In the first embodiment, the time when the driving of the suction pump during initial filling and the filling of the reserve tank with ink during initial filling are simultaneously performed is uniformly determined by the driving time of the suction pump 20. That is, even if the filling of the reserve tank 10 with ink has not been completed, the process proceeds to the next step after the set driving time of the suction pump 20 has elapsed. In contrast, in this embodiment, the process does not proceed to the next step until the filling of the reserve tank 10 with ink is completed. In addition, in this embodiment, the suction pump 20 is driven until the filling of the reserve tank 10 with ink is completed.

FIG. 11 is referred to again. When the operation in S1004 and S1005 ends, the valve 16 is opened (S1006). Then, ink is supplied from the ink tank 9 and the reserve tank 10 to the printhead 3, which is the same as described above. At that time, the amount of ink which flows into the printhead 3 varies depending on the amount of air in the reserve tank 10. For example, when there is no ink in the reserve tank 10, the amount of air in the reserve tank 10 is 15 ml. In this state, when the valve 16 is opened, negative pressure in the flow path 17 and the printhead 3 is transmitted to 15 ml of air in the reserve tank 10 and is then transmitted to the ink tank 9. Therefore, air in the reserve tank 10 functions as a buffer and a relatively small negative pressure value is applied to the ink tank 9. As a result, the moving speed of ink or the amount of ink moved is reduced, which results in a reduction in ink supply efficiency (ink filling efficiency). It is preferable that the amount of air in the reserve tank 10 before the valve 16 is opened be relatively small in order to increase the efficiency of filling the flow path 17 and the printhead 3 with ink. In this embodiment, before the valve 16 is opened, the filling of the reserve tank 10 with ink is completed. Therefore, the amount of air in the reserve tank 10 is the minimum and it is possible to improve filling efficiency.

The CPU 101 determines whether the process from S1003 to S1006 has been performed N times (S1007). Here, the number of times the process from S1003 to S1006 is repeated is set to 3. When determining that the process from S1003 to S1006 has not been performed N times (NO in S1007), the CPU 101 returns to S1003. When determining that the process from S1003 to S1006 has been performed N times (YES in S1007), the CPU 101 performs the same process as that from S709 to S711 in FIG. 7 (S1008 to S1010) and ends the process (S1011).

As described above, in this embodiment, the ink filling time in the initial state can be shorter than that in the structure according to the related art. In this embodiment, after the filling of the reserve tank 10 with ink is completed, the valve 16 is opened. Therefore, it is possible to improve the efficiency of supplying ink to the flow path 17 and the printhead 3, as compared to the structure in which the valve 16 is opened before the filling of the reserve tank 10 with ink is completed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-105844, filed May 25, 2015, which is hereby incorporated by reference wherein in its entirety.

What is claimed is:

1. An inkjet printing apparatus comprising:

a printhead having a discharging port surface on which a discharging port for discharging ink is formed;

a first tank for storing ink to be supplied to the printhead;

a second tank for storing ink to be supplied to the first tank;

a valve that can be switched between an open state in which the printhead communicates with the first tank and a closed state in which the printhead does not communicate with the first tank;

a cap for covering the discharging port surface;

a pump for generating a negative pressure in an inside of the cap when the cap covers the discharging port surface; and an internal pressure changing member for changing an internal pressure of the first tank; and a control unit configured to perform a first filling operation which includes causing the pump to be driven when the cap covers the discharge port surface and the valve is in the closed state so as to generate the negative pressure in the inside of the cap, and then causing the valve to be switched to the open state, so that ink is supplied from the second tank to the printhead through the first tank, and configured to perform a second filling operation which includes causing the internal pressure changing member to be driven so that ink is supplied from the second tank to the first tank, wherein the control unit performs the second filling operation in parallel with performing the first filling operation.

2. The inkjet printing apparatus according to claim 1, wherein the control unit performs the second filling operation when the valve is in the closed state, and does not perform the second filling operation when the valve is in the open state.

3. The inkjet printing apparatus according to claim 2, wherein the control unit performs the second filling operation during a time from the valve being caused to be the closed state to the valve being switched to be the open state in the first filling operation.

4. The inkjet printing apparatus according to claim 2, wherein the control unit completes ink filling to the first tank during causing the internal pressure changing member to be driven for the second filling operation.

5. The inkjet printing apparatus according to claim 2, wherein the control unit completes the first filling operation after completing the second filling operation.

6. The inkjet printing apparatus according to claim 2, wherein the valve is switched to be open state after completion of the second filling operation.

7. The inkjet printing apparatus according to claim 2, wherein the valve is repeatedly switched between the closed state and the open state until a flow path communicating the printhead with the first tank and the printhead are filled with a predetermined amount of ink.

8. The inkjet printing apparatus according to claim 2, further comprising a detecting unit configured to detect an amount of ink in the first tank, wherein the control unit determines whether ink filling to the first tank is completed based on a detection result from the detecting unit.

9. The inkjet printing apparatus according to claim 1, wherein the internal pressure changing member changes the internal pressure of the first tank by that a volume of the internal pressure changing member is expanded and contracted.

10. A control method of an inkjet printing apparatus including a printhead having a discharging port surface on which a discharging port for discharging ink is formed, a first tank for storing ink to be supplied to the printhead, a second tank for storing ink to be supplied to the first tank, and a cap for covering the discharging port surface, the control method comprising:

a first step of generating a negative pressure in an inside of the cap with the cap covering the discharging port surface when the printhead does not communicate with the first tank;

a second step of changing an internal pressure of the first tank after the first step to supply ink from the second tank to the first tank; and a third step of causing the printhead and the first tank to communicate with each other after the second step to supply ink from the second tank to the printhead through the first tank.

* * * * *